US005111788A

United States Patent [19]

Washino

[11] Patent Number: 5,111,788

[45] Date of Patent: May 12, 1992

[54] ROTATION SPEED CONTROL DEVICE OF AN INTERNAL COMBUSTION ENGINE

[75] Inventor: Shoichi Washino, Amagasaki, Japan

[73] Assignee: Mitsubishi Denki K.K., Tokyo, Japan

[21] Appl. No.: 629,329

[22] Filed: Dec. 19, 1990

[30] Foreign Application Priority Data

Jan. 12, 1990 [JP] Japan ..... 2-5187

[51] Int. Cl.[5] ..... F02D 41/16

[52] U.S. Cl. ..... 123/339; 123/418; 290/40 A

[58] Field of Search ..... 123/339, 418; 290/40 A, 290/40 C

[56] References Cited

U.S. PATENT DOCUMENTS

| | | | |
|---|---|---|---|
| 4,520,272 | 5/1985 | Danno et al. | 123/339 X |
| 4,572,127 | 2/1986 | Morris | 123/418 X |
| 4,651,081 | 3/1987 | Nishimura et al. | 123/339 X |
| 4,862,851 | 9/1989 | Washino et al. | 123/339 |
| 4,989,565 | 2/1991 | Shimomura et al. | 123/339 |

FOREIGN PATENT DOCUMENTS

| | | |
|---|---|---|
| 61-43535 | 9/1986 | Japan . |
| 61-53544 | 11/1986 | Japan . |

*Primary Examiner*—Tony M. Argenbright
*Attorney, Agent, or Firm*—Sughrue, Mion, Zinn, Macpeak & Seas

[57] ABSTRACT

There is disclosed a rotational speed control device of an internal combustion engine wherein a variation in torque which is a disturbance is detected in order to control the relation between the flow rate of intake air (or the quantity of fuel injected) and the amount of the electric current produced by an alternator, and to reduce the amount of the electric current produced by the alternator only during a period when an increment in the intake air (or the fuel injection) is delayed, thereby stabilizing the engine speed. Also disclosed is a rotational speed control device according to another embodiment of the present invention. This control device detects the variation in torque to control the relation between the amount of the electric current produced by the alternator, the flow rate of the intake air (or the quantity of fuel injected) and the ignition timing, to decrease the amount of the electric current produced by the alternator, and to advance the ignition timing only during a period when an increment in the intake air (or the fuel injection) is delayed, thereby stabilizing the engine speed.

4 Claims, 7 Drawing Sheets

ROTATION SPEED CONTROL DEVICE OF AN INTERNAL COMBUSTION ENGINE

BACKGROUND OF THE INVENTION

1. Field of the Invention

The present invention relates to an electronically controlled fuel injection system or a rotational speed control device in a diesel engine mounted in a motor vehicle.

Various kinds of auxiliary devices have recently come to be mounted in motor vehicles in order to meet variety of demands. Of these devices, some are designed to be driven by rotation of an engine; and there are many large loads which change by their operation the rotational speed, particularly an idle speed, of the engine.

For example, an air-conditioning system, a power steering system, and a device, such as a defogger, which consumes much electric current, have such a shortcoming that as it operates, the load torque of a generator (alternator) to the engine increases, resulting in a large drop in the rotational speed and possibly the engine stopping. An example of a conventional engine, especially a gasoline engine, will be described with reference to drawings.

FIG. 5 is a block diagram of a conventional engine speed control system. In this drawing, numeral 1 denotes a voltage setting circuit which outputs a set signal having a voltage level in accordance with a desired target speed. Both the set signal and a detection signal, having a voltage level corresponding to an actual engine speed outputted from the speed detection circuit 5, are supplied to a subtractor 11. The subtractor 11 calculates a difference between the set signal and the detection signal, and outputs it to a controller 2. This controller 2 often includes a proportional integral controller having a circuit for amplifying a deviation signal and a circuit for integrating this deviation signal, both of which are in parallel connection.

An actuator 3 is designed to regulate the ignition timing or the intake air flow rate of an engine 4 in accordance with the voltage output of the controller 2.

The speed control system ranging from the input end of the actuator 3 to the engine 4 and the output end of the speed detection circuit 5 shown in FIG. 5 may be expressed in terms (345) of one transmission function as shown in FIG. 6.

Next, operation of a conventional engine speed control system will be explained by referring to FIG. 5. First, suppose that a target voltage signal corresponding to a target speed (generally, this target speed varies with the operating point of engine, 800 to 900 rpm when the air-conditioning system is on at the idle speed of engine) is outputted from the setting circuit. Next, the subtractor 11 calculates a difference between this target voltage signal and the voltage signal corresponding to an actual engine speed outputted from the speed detection circuit 5, producing a deviation signal. Then, this deviation signal is amplified proportionally and integrally by the proportional integral controller 2, which sends this voltage signal as a manipulated variable to the actuator 3.

The actuator 3 controls the ignition timing or the intake air flow rate of the engine 4 in accordance with this voltage signal. The engine 4 operates at an actual speed corresponding to the ignition timing or the intake air flow rate commanded by the actuator 3. The speed detection circuit 5 generates a voltage signal corresponding to this actual number of revolutions. The voltage signal thus generated in accordance with this actual speed is fed back to the subtractor 11 side.

By the way, it goes without saying that such a feedback control system, in a steady state, settles down where the deviation signal becomes zero. At this time, the voltage signal corresponding to the target speed and the voltage signal corresponding to the actual speed become equal, and accordingly the engine speed equals the target speed. That is, in the steady state, the engine speed is so controlled as to be always equal to the target speed.

Next, the operation of the speed control device in a transient state will be explained, using a typical example of a transient state wherein a load (for example the air-conditioning system) is suddenly applied at an idle speed of engine.

Now, suppose that when the control system shown in FIG. 5 is in a steady state, a load is abruptly applied to the engine, resulting in a sudden drop of engine speed. At this time, since the voltage signal outputted from the speed detection circuit 5 also drops, the deviation signal becomes a positive voltage signal, whereby operating the control system to raise the speed of the engine 4 through the proportional-integral controller 2 and the actuator 3, thus the engine recovers to the original target speed.

In order to increase the engine speed to the original target speed as quickly as possible within this process, it is evidently desirable to increase proportional and integral gains at the proportional-integral controller 2 which receives the deviation signal and to give the actuator 3 a great voltage signal in relation to the same deviation signal. That is , it is possible to quickly raise the lowered engine speed back to the target speed by increasing the sensitivity of the control system.

Generally, it is very important to increase the sensitivity of the control system by increasing the proportional and integral gains of the proportional-integral controller in the feedback control system as stated above in order to (A) quickly eliminate the influence of disturbance and (B) gain a specific result of control irrespective of characteristic variation or dispersion of an object of control. In an actual engine speed control system, however, it is commonly a matter of great difficulty to increase the sensitivity of the control system because increasing the sensitivity of the control system causes engine hunting to occur. Commonly, in the case of the engine, when, for example, the actuator 3 operates to control the intake air flow rate, the transmission characteristic from the intake air flow rate to the engine speed shows the following shortcomings: (A) the presence of a secondary delay factor by which the phase delays 180 degrees, and the occurrence of a tertiary delay which causes a phase delay of 270 degrees when an actuator delay is included, and (B) the presence of an idle time factor resulting from a stroke delay; and therefore if the sensitivity of the control system is increased (to a high gain), the control system itself becomes unstable, causing hunting to occur. This occurrence of hunting caused by the increase in the proportional and integral gains is empirically well known. It is, therefore, necessary to theoretically prove it as a common phenomenon.

This point will be described in detail by referring to FIG. 6 and using equations. In FIG. 6, let Gc(S) and $G_{345}(S)\,e^{-SL}$ be respectively the functions of the proportional-integral controller 2 and the transmission function (345). r be the voltage signal of the setting circuit 1, and y be the output (voltage signal) of the transmission function (345), and the closed-loop transmission function y/r will be given by the following equation.

$$\frac{y}{r} = \frac{Gc(S)\,G_{345}(S)\,e^{-SL}}{1 + Gc(S)\,G_{345}(S)\,e^{-SL}} \quad (2)$$

Therefore, a characteristic equation which governs the stability of the control system will be given by the following equation:

$$1 + Gc(S)G_{345}(S)e^{-SL} = 0 \quad (3)$$

where Gc (S) is the transmission function of the proportional-integral controller 2.

As is well known, stability analysis using the equation (3) can be executed by drawing a Nyquist diagram. The stability of the control system will be analyzed by actually drawing a Nyquist diagram.

First, let K be a proportional gain and Ti be an integral gain (integral action time), and Gc (S) which is proportional-integral is given by $$Gc(S) = \frac{1 + SKTi}{Sti} \quad (4)$$

In the meantime, the transmission function $G_{345}(S)$ from the actuator to the engine can be accurately approximated with the secondary delay of $$G_{345}(S) = \frac{1}{(1 + ST)^2} \quad (5)$$

when the actuator makes a very quick response. Here, T is a time constant, and depends upon the engine speed, the moment of inertia of a flywheel, and the capacity of a surge tank. The time constant is of the order of 0.3 sec at a balanced engine speed No=750 rpm. When the delay time L is equal to a time required for four strokes, $4 \times 60/(2 \times No) = 0.16$ sec at the balanced engine speed No=750 rpm. By substituting $S = j\omega$ into the equations (4) and (5) to give modified equations, $\omega KTi = \omega T \times (K\text{-}Ti/T)$, $\omega Ti = \omega t \times (Ti/T)$, and $\omega L = \omega T \times (L/T)$, and by drawing a Nyquist diagram using K and Ti as parameters, a diagram in FIG. 7 for example is obtainable. In this drawing, a full line indicates the stability of the control system when K=0 and Tn=Ti/T=1 (namely, when only an integrator is used as a controller) (in this case, Ln=L/T=0.5). As is clear from the drawing, the phase is 180 degrees at the frequency f=0.37 Hz, and an absolute value is 0.96, from which it is understood that the control system is at the limit of stability (in actual operation, these values are negligible). From each Nyquist diagram using K and Ti as parameters, it is understood that the control system will become unstable at a frequency ranging from 0.3 Hz to 0.7 Hz. In the meantime, according to an experimental result, within this frequency range the idle speed control system becomes unstable and the hunting occurs within the frequency of 0.3 Hz to 0.7 Hz. From this, a result of the analysis described above is understood to agree very well with a result of experiments. From this analysis the range of K and Ti where the control system stability is obtainable will be K=1 to 2 and Ti/T being above 1. This result also agrees with the result of experiments. From the above-mentioned analysis, it is understood that (A) the control system will become unstable (both the proportional and integral gains can not be increased) if the proportional gain K of the idle speed control system is held under about 2 and the integral time Ti held greater than 0.3 sec, and that (B) accordingly, it is impossible to improve the sensitivity (high gain) of the control system, resulting in a poor response characteristic (follow-up characteristic) to disturbance and accordingly in an engine stop in the event of sudden application of a great load.

Another cause of the poor response characteristic (follow-up characteristic) to disturbance of the idle speed control system and the occurrence of engine stop in the event of sudden application of a great load lies in that only the intake air flow rate is controlled, without accurately grasping the dynamic characteristics of the alternator and accordingly without taking any reasonable and effective measure in relation to the load. This will be described in detail by referring to FIG. 8 and using an example particularly of an electric load disturbance.

In FIG. 8, numerals 11*a* to 11*d* denote subtractors; numeral 100 represents the primary delay characteristic of an intake manifold; numeral 101 represents characteristics in connection with a torque produced by fuel combustion in the engine; numeral 102 represents a primary delay in connection with a rotating section; numeral 103 represents a feedback gain of a regulator; numeral 104 represents a primary delay characteristic of a field circuit; numeral 105 represents a torque conversion efficiency; and numeral 106 represents a set voltage for the regulator. Above the broken line is shown the dynamic characteristic of the engine, and under the broken line is shown the dynamic characteristic of the alternator. The dynamic characteristic of the alternator is obtained by formulating variations from a balanced state, from relationships established among the field current If, load current Ia, and excitation voltage Ea. Complicated relationships will not be described in detail because it will disturb the qualitative understanding of phenomena; hereinafter, therefore, only brief description will be given with reference to a block diagram. In this block diagram, the operation of the voltage regulator mounted to the alternator is expressed by a feedback loop including the feedback gain Kf. The exciting voltage Ea is proportional to the product of alternator rotor speed (engine speed x pulley ratio) and the field current If, and the torque T demanded of the engine is proportional to the product of the load current Ia, the alternator rotor speed (engine speed×pulley ratio) and the field current If. Therefore, formulation of variations (expressed with Δ) from values of these various quantities in a balanced state will give the dynamic characteristic of the alternator below the broken line in FIG. 8. Here, To denotes a conversion coefficient for providing a torque demanded of the engine in a balanced state. Also, the variations, excepting that of the torque, are normalized by values all in the balanced state (indicated by *).

Using the same diagram, how deeply the characteristics of the alternator is related with engine speed stability will hereinafter be described. In this diagram, suppose that the load current has increased by ΔIa* and the torque by To.ΔIa*. Normally, since an increase in the intake air flow rate has an influence upon the torque after some delay, an increase in the torque affects the engine speed with delay, lowering the engine speed by $\Delta N^*$. Thus this lowered engine speed reduces the exciting voltage of the alternator, and the voltage regulator functions to increase the field current by $\Delta If^*$, thereby further increasing torque demanded of the engine, to To $(\Delta Ia^* - \Delta If^*)$. Namely, the more the engine speed decreases, the more the alternator increases the torque demanded of the engine, further lowering the engine speed. In other words, the alternator operates towards deteriorating the stability of the engine speed. From this it is clear that the use of a conventional speed control system which controls only the flow rate of intake air without taking into account the characteristics of the alternator described above, has a low capacity to eliminate speed variations caused by load disturbance.

There have been proposed various devices for improving the above-described conditions. There is often adopted such a computerized method (a kind of feed-forward function) wherein a switch signal from an air-conditioning system for example is fed into a computer, which, upon knowing the start of operation of the air-conditioning system before the actual application of the load of the air-conditioning system to the engine, drives the actuator (3) prior to the actual application of the load to the engine. According to this method, however, if there exists a large delay between the supply of the switch signal to the computer and the actual application of load of the air-conditioning system to the engine, the engine speed in some cases shows a sudden rise and then a drop, giving a driver an unpleasant impression.

A feedback control system shown in FIG. 9 has been proposed as one example of such improvements in Japanese Examined Patent Publication No. 61-43535. In this drawing, numeral 6 denotes a detecting circuit which outputs a detection signal, or voltage, corresponding to a decrease in the engine speed. The detection signal outputted from this detecting circuit 6 and a detection signal outputted from the speed detecting circuit 5 are added by an adder 12, and a result of this addition is outputted to the subtractor 11.

Next, the operation shown in FIG. 9 will be described. In this drawing, suppose that this control system in a steady state as previously stated is suddenly affected by load disturbance, resulting in a rapid decrease in the engine speed. In this case, circuits ranging from the setting circuit 1 to the speed detecting circuit 5 function in an identical manner. In FIG. 9, however, the voltage proportional to the deceleration of the engine is excessively fed back from the detecting circuit 6 which outputs an output signal of voltage proportional to the deceleration. Thus a deviation signal will become greater as compared with the operation shown in FIG. 5 and accordingly the original target speed is recovered much more rapidly as compared with FIG. 5.

The engine can recover the original target speed more rapidly than FIG. 5 because of the implementation of this one kind of feed-forward function. To accomplish the initial object of feed-forward compensation, the engine speed must vary. However, since this variation in the engine speed delays operation, it is difficult to totally eliminate speed variation.

According to Japanese Examined Patent Publication No. 61-53544, the control of ignition timing by the actuator 3 shown in FIG. 5 has been proposed. Generally, either the intake air flow rate or the ignition timing is controlled in order to control the engine speed. In this case, the ignition timing, making a quicker response than the other, is controlled, whereby the effect of disturbance to lower the speed can be removed quickly. However, because of a limited range of speed that can be controlled by the ignition timing, the above-mentioned method is not so effective when a great load exceeding the range is applied.

As explained with reference to FIGS. 5 and 9, the conventional engine speed control device is capable of quickly eliminating the effect of load disturbance on the engine and recovering the engine speed to the original target speed; however, as only either the intake air flow rate or the ignition timing is controlled without considering the dynamic characteristics of the alternator, its effect is limited.

SUMMARY OF THE INVENTION

The present invention has been accomplished in an attempt to solve the problems mentioned above. And its object is to provide an engine speed control device which can perform synthetic, reasonable control of not only the intake air flow rate but the torque that the alternator demands of the engine, with the dynamic characteristics of the alternator taken into consideration, thereby quickly eliminating the effect of load disturbance and recovering the original target speed.

The speed control device of an internal combustion engine according to the present invention is so constituted as to detect torque variation which is disturbance, control the relation between the intake air flow rate (or the quantity of fuel injected}and the amount of alternating current produced by the alternator in accordance with this torque variation, and to reduce the amount of alternating current produced by the alternator only when the increment of the intake air (or the quantity of fuel injected) is delayed, thus stabilizing the engine speed.

A speed control device of an internal combustion engine according to another embodiment of the present invention has means to detect torque variation which is disturbance, controls the relation between the amount of alternating current produced by the alternator, the intake air flow rate (or the quantity of fuel injected) and the ignition timing in accordance with the torque variation described above, decreases the amount of alternating current produced by the alternator and advances the ignition timing, thereby stabilizing the engine speed.

The speed control device of an internal combustion engine according to the present invention directly detects disturbance, and synthetically controlling the target voltage (set voltage) of the voltage regulator mounted to the alternator and the feedback gain of the regulator in accordance with the amount of disturbance, the control device controls the field current (accordingly the torque that the alternator demands from the engine), thus quickly settling engine speed variations caused by the disturbance.

Furthermore, the speed control device of an internal combustion engine in accordance with another embodiment of the present invention controls the alternator and the ignition timing as well, quickly settling engine speed variations caused by disturbance.

Other objects, features and advantages of the present invention will appear hereinafter as the description proceeds.

DESCRIPTION OF THE PREFERRED EMBODIMENTS

Figure 1:
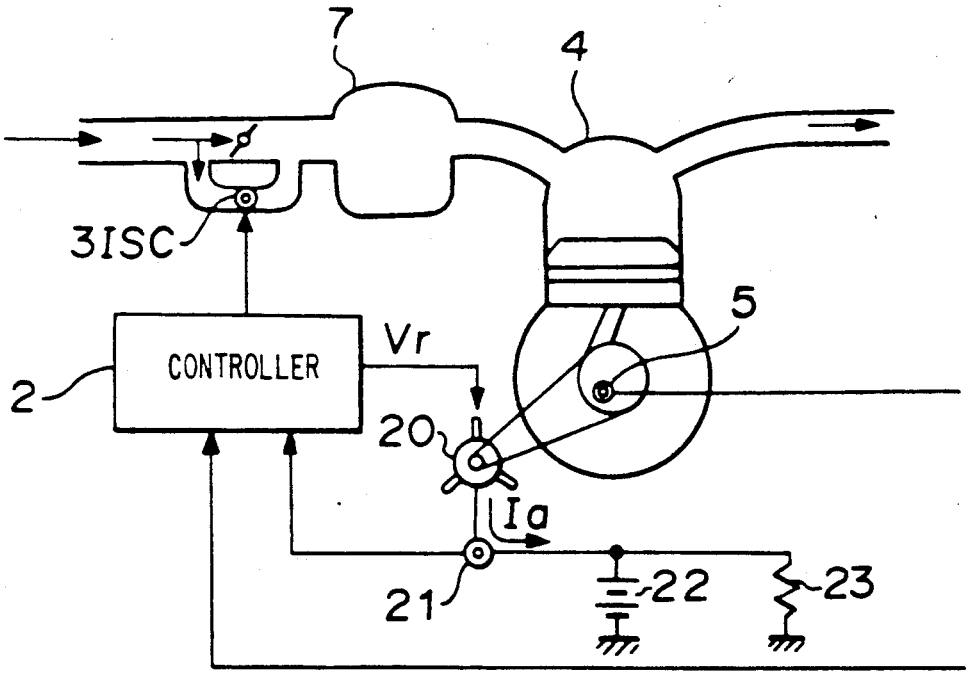
FIG. 1 is a block diagram showing the concept of a speed control device of an internal combustion engine according to a first embodiment of the present invention.

Hereinafter exemplary embodiments of an engine speed control device according to the present invention will be described with reference to the accompanying drawings. FIG. 1 is a block diagram showing the concept of an engine speed control device according to a first embodiment of the present invention.

In this drawing, numeral 3 denotes an actuator (ISC valve) which controls the air flow rate, numeral 4 designates an engine, numeral 5 designates speed detecting circuit which detects the engine speed obtained from a crank angle (in this drawing, the crank angle is used for the detection of the engine speed, which, however, must not be adhered to at all), numeral 7 designates an intake pipe, numeral 2 denotes a controller, numeral 21 denotes a current sensor which detects a load current of the alternator 20, numeral 22 designates a battery, numeral 23 represents, in resistance, the electrical loads such as headlamps and power windows.

Figure 8:
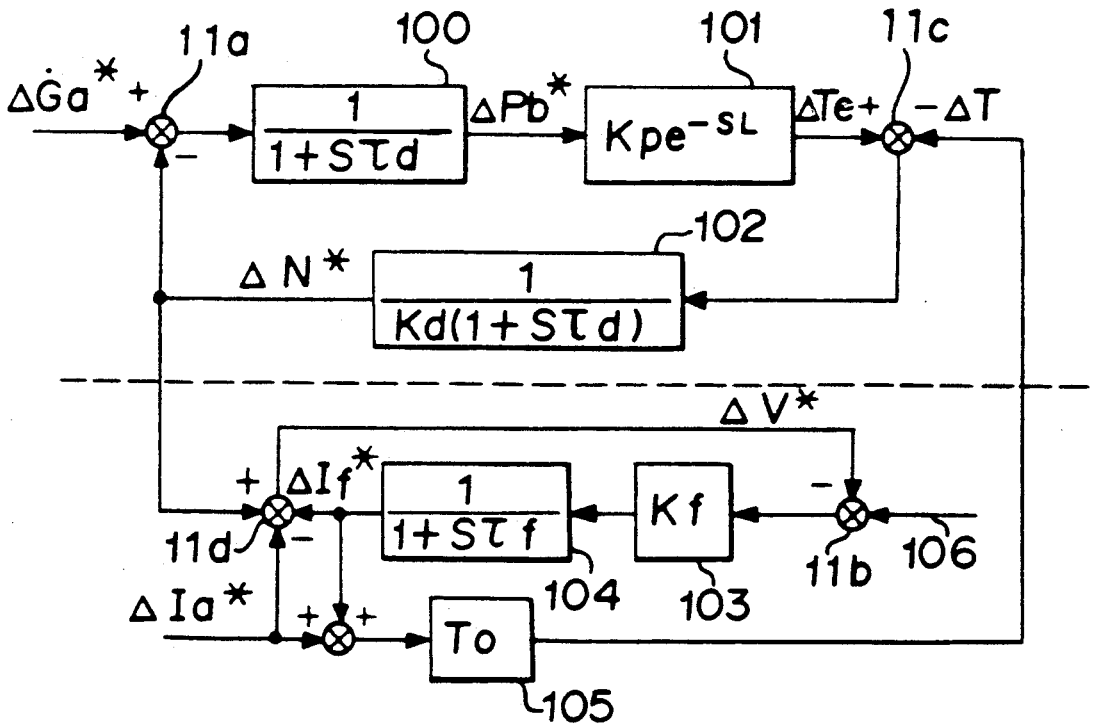
FIG. 8 is a block diagram of the alternator including the engine and the regulator.
Figure 9:
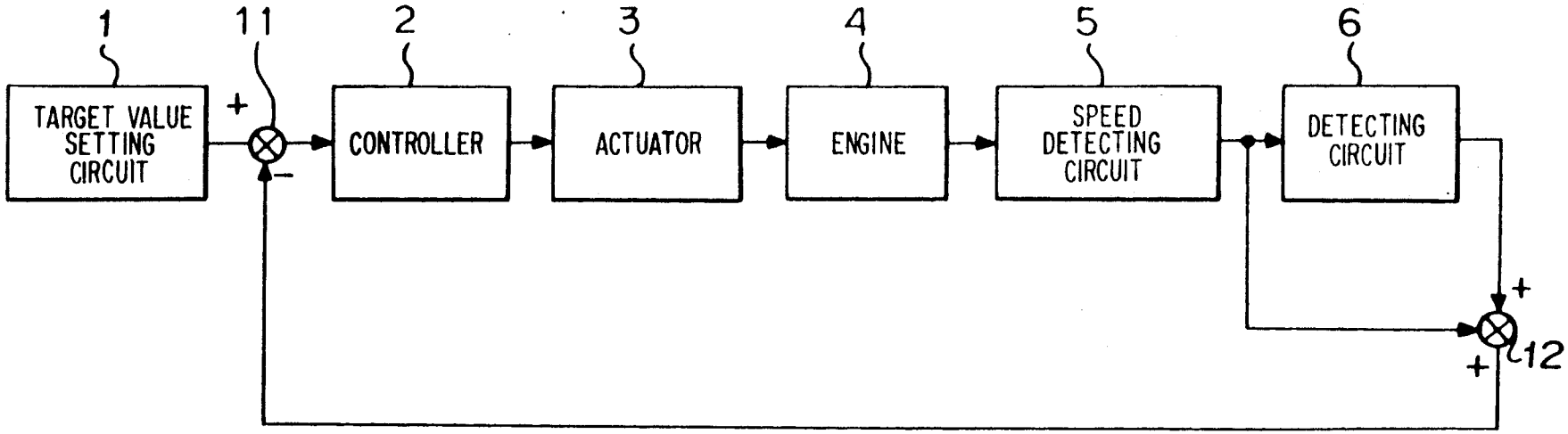
FIGURE 9 PRIOR ART
FIG. 9 is a block diagram showing another conventional engine speed control device.

Now, presume that a headlamp switch for example is turned on and the load current of the alternator 20 increases by $\Delta Ia^*$ as a typical load disturbance. This increment in the load current adds an increased torque to the engine as explained in FIG. 8. It is also manifest that if the engine can produce the same amount of torque as the increased torque added thereto, there occurs no variation in the engine speed. It is also apparent that if one tries to supply an increased amount of intake air for compensating for the increase in torque, the intake air must be fed quickly to compensate for and thus remove the delay characteristic associated with the intake pipe 7 (this characteristic is expressed by a primary delay as described later). This, however, requires an actuator (ISC valve) which can make a very quick response. That is, in order to compensate for the delay characteristic of the intake pipe 7 simply by supplying the intake air, the actuator 3 is required to make a very quick response. In the above-described operation, no control is made as to the alternator 20, therefore, the regulator for maintaining constant the voltage produced by the alternator 20 is operated to the fullest extent. It is clear that when the load current has increased, it is possible to free the engine from the excess load from the alternator 20 by reducing the set voltage of the regulator to zero and accordingly the amount of electricity generated also to zero (at this time, the current is supplied to the load from the battery). In other words, it is understood that if the response of the actuator 3 delays too much to increase the torque produced by the supply of the intake air when the load current has increased, it is necessary to lower the set voltage of this regulator during the period of this delay in order to decrease the amount of electricity to be generated and accordingly to diminish the load from the alternator 20. And, after the actuator 3 has reached its normal operation required, it is possible to gradually increase the set voltage of the regulator until finally the normal set voltage is reached, where the engine speed will not vary. This is the essence of this invention.

The present invention discloses a concrete method concerning the control of the engine speed by combining the amount of the intake air and the set voltage of the regulator for changing the amount of the intake air in response to the set voltage of the regulator and for controlling the set voltage of the regulator in response to the amount of the intake air respectively.

Figure 2:
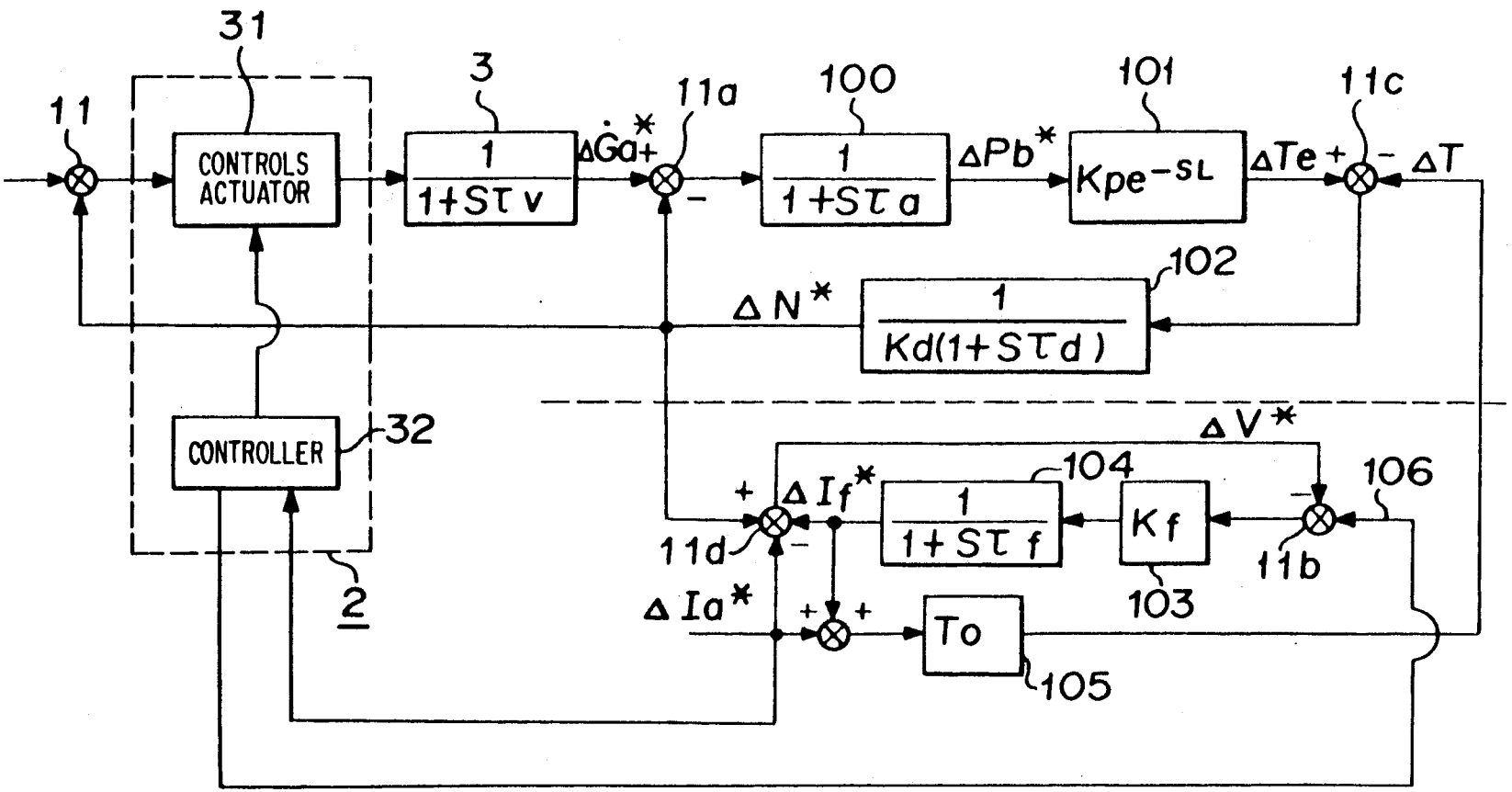
FIG. 2 is a block diagram showing a relation between the dynamic characteristics of an actuator and an alternator in FIG. 1 and a controller.

Hereinafter this method will be described in detail with reference to the block diagram. FIG. 2 shows the dynamic characteristics of the engine, the actuator, and the alternator including the function of the voltage regulator, and the controller.

In this diagram, numeral 3 denotes a primary delay expressing the dynamic characteristics of the actuator which controls the air flow rate; numeral 100 denotes a primary delay expressing the dynamic characteristics of the intake pipe (intake manifold); numeral 101 denotes the dynamic characteristics expressing the production of engine torque; numeral 102 indicates a primary delay expressing the dynamic characteristic of a rotary section of the engine; and the subtractor 11*a* shows intrinsic mechanical feedback characteristics of the engine. Numerals 3 to 102 are block diagrams showing engine characteristics. In the meantime, the block diagram given below the dash line in FIG. 2 is the block diagram (explained in FIG. 8) showing the dynamic characteristics of the alternator. That is, numeral 103 is an effective feedback gain; and numeral 104 denotes the primary delay of a field circuit which is expressed by the serial connection of a resistor, a coil and an inductance. This diagram includes the subtractor 11*b*, the effective feedback gain 103 and the primary delay of the field circuit 104, showing the control function of the voltage regulator mounted to the alternator. Numeral 105 denotes the conversion coefficient (a parameter) for the conversion of the field current and load current of the alternator into a torque demanded of the engine.

Next, operation of the speed control device will be described in detail. The dynamic characteristics of the actuator 3 indicates that if the input $\Delta Va^*$ for operating the actuator (also called an ISC valve) is suddenly changed, the air flow delays. The primary delay characteristic 100 indicates the characteristic that the air is changed into an intake pressure after flowing into the intake pipe 7. Numeral 101 expresses characteristics related to a torque produced by fuel combustion in the engine. Here, Kp denotes a conversion coefficient at which the air drawn into the engine (proportional to the intake pressure Pb which is the output of the primary delay characteristic 100) burns to turn into a torque and an idle time $e^{-SL}$ expresses a time delay until the combustion. The primary delay characteristic 102 is obtained from Euler's equation that the number of revolutions differentiated is the torque. The subtractor 11*a* indicates the following intrinsic mechanical feedback characteristics of the engine. Generally, during idling (or when the intake pressure is very low), the state of critical flow is realized by a throttle valve. The flow rate of the air flowing through the throttle valve becomes constant. If some disturbance (for example a torque disturbance caused by an increase in the current when the headlight switch is turned to on) is applied to the engine operating under the above-mentioned condition, the engine speed lowers, increasing the intake pressure. The flow rate of the air drawn into the engine is expressed by $C \times Pb \times N$, in which Pb for the intake pressure, N for the engine speed and C for constant coefficient, $C \times Pb \times N = \text{constant}$; therefore, Pb must increase with a decrease in N (a phase delay of the increase in Pb may be neglected because of its simplicity). The torque produced by the engine increases with an increase in the intake pressure Pb, finally increasing the engine speed. That is, with a decrease in the engine speed, a restoring force, reversely, works towards increasing. Its effect is negative feedback, being expressed by the negative feedback of the subtractor 11*a*.

Next, the dynamic characteristics of the alternator (shown at the bottom of FIG. 2) will be described. As is known well, the alternator 20 is provided with a voltage regulator for maintaining the generated voltage constant (generally, at about 14 V). This device utilizes the negative feedback function to control the voltage generated, to a constant value. This control is a duty control of the current supplied to the field circuit, which functions to lower the duty ratio with an increase in the voltage generated, and reversely to raise the duty ratio with a decrease in the voltage, thus maintaining constant generated voltage. The substance of this duty control may be expressed by the control gain Kf 103 of the voltage regulator, the primary delay characteristics 104 comprising a series connection of the field coil inductance Lf and a circuit resistance, and the subtractor 11*b* expressing the negative feedback of the regulator. Furthermore, the torque which the alternator 20 demands from the engine by its current producing function is proportional to the product of the load current Ia and the field current If; and therefore, in a linearized model, the torque can be expressed as shown in FIG. 2, using the factor of proportionality To 105. The input 106 to the subtractor 11*b* represents the set voltage applied to the regulator. In the linearized model around a position of equilibrium as shown in FIG. 2, the set voltage, when left constant, may be expressed as zero.

The subtractor 11 shows an electrical feedback of rotational speed. The input to this subtractor from left indicates the target rotational speed of the engine to be controlled. The target value setting circuit 1 is not illustrated here.

The rectangular part enclosed with a broken line is the controller 2, which comprises a section 31 controlling the actuator 3 and a section 32 detecting the load current of the alternator to control the set voltage of the regulator.

As previously described in FIG. 1, the substance of the present invention resides in constantly maintaining a fixed engine speed against any load disturbance (in the case of electrical load, it is equivalent to a variation in the load current of the alternator) by synthetically controlling the relation between the section 31 which controls the actuator 3 and the section 32 which controls the set voltage of the regulator by detecting the load current (load disturbance) of the alternator.

One example of this synthetic control operation, particularly the electrical load disturbance, will hereinafter be described with reference to FIG. 3*a* to 3*d*. Now, suppose that the load current of the alternator has changed in steps as an electrical load disturbance (FIG. 3*a*). When the actuator 3 is operated as shown in FIG. 3*b* in accordance with the current in the event of a stepped variation in the load current of the alternator, the intake air flow rate delays to rise as shown in FIG. 3*c*. This is due for example to the primary delay characteristic of the actuator 3. Under this condition, therefore, the engine torque produced is insufficient until the complete rising of the intake air flow rate, resulting in a lowered engine speed. During the period until this rising of the intake air flow rate, the set voltage of the regulator is gradually increased after once decreasing as shown in FIG. 3*d* in order to reset to the set voltage. By doing as described above, the insufficient part of the engine torque generated is compensated for by holding the torque demanded by the alternator (during this period the battery is used to supply the current to the load) until the complete rising of the intake air flow rate, thus enabling the variation in the engine speed. The qualitative description of the present invention has been given; however, unless the above-mentioned condition is corrected, it is difficult to have qualitative understanding of "How should the set voltage of the regulator be controlled concretely?" Therefore, hereinafter the stepped variation in the load current of the alternator will be quantitatively explained. In FIG. 2 showing a linearized model of variation in various kinds of physical quantities around the position of equilibrium, transmission characteristics from the input Va* supplied to the actuator 3 to a variation in the engine speed ΔN* is obtained as the following equation.

$$\Delta N^* = \{Kp \cdot \Delta Va^* - (1 + S\tau a)(1 + S\tau v) \cdot (\Delta Vr^* + \Delta 2Ia^*) \cdot To\}/f(S) \quad (1)$$

where the denominator f (S) is given by the following equation.

$$f(S) = (1 + S\tau v)[Kp - Kd - To + S\{\tau a(Kd - To) + KD\tau d\} + S^2 Kd \cdot \tau a \tau d]$$

where τv is the time constant of the air flow rate actuator, τa is the time constant of the intake manifold $(= 120/\eta v No) \times (Vm/Vh))$, τd is the time constant of the rotating part (=J/c) and a ratio of the moment of inertia J and the coefficient of resistance, Kp is the coefficient of conversion from the intake pressure to the torque, Kd is the friction of the rotating part, Vm is the volume of the intake manifold, Vh is the engine displacement, and ηv is the volumetric efficiency. Definitions of other symbols are as previously stated. In this case, the idle time is neglected.

Since, in the equation (1), the numerator may be zero in order to give a variation in the rotational speed $\Delta N^* = 0$, the following equation is established.

$$Kp\Delta Va^* = (1 + S\tau a)(1 + S\tau v) \times (\Delta Vr^* + 2\Delta Ia^*)To$$

Now, supposed that the input ΔVa* to the actuator 3 is controlled in proportion to the variation of the alternator load current ΔIa*. Let 2To/Kp be the proportional coefficient, and $\Delta Va^* = 2To/Kp \times \Delta Ia^*$. Therefore, from the above equation the following equation is established.

$$2\Delta Ia^* = (1 - S\tau a)(1 - S\tau v) \cdot (\Delta Vr^* - 2\Delta Ia^*)$$

by solving this equation as to $\Delta Vr^*$, the following equation is given.

$$\Delta Vr^* = -\frac{2S\{S\tau a\tau v - \tau v - \tau a\}}{(1 - S\tau a)(1 - S\tau v)} \cdot \Delta Ia^* \quad (6)$$

Figure 3:
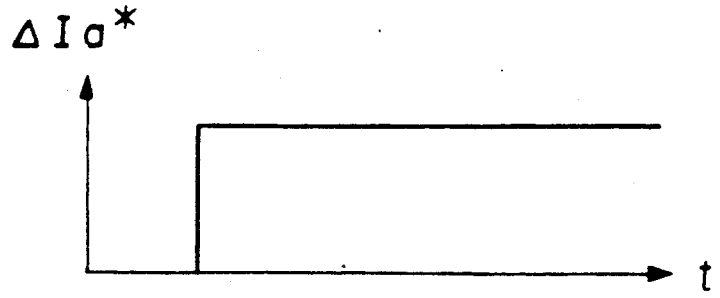
FIGS. 3*a* to 3*d* are timing charts showing variations in the load current of the alternator, operation of the actuator, a variation in the flow rate of intake air, and the set voltage of the regulator.
Figure 3:
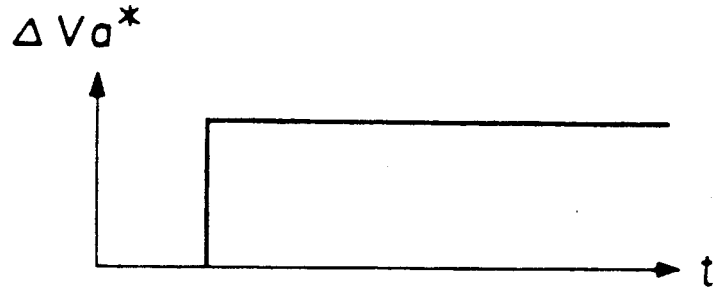
Figure 3:
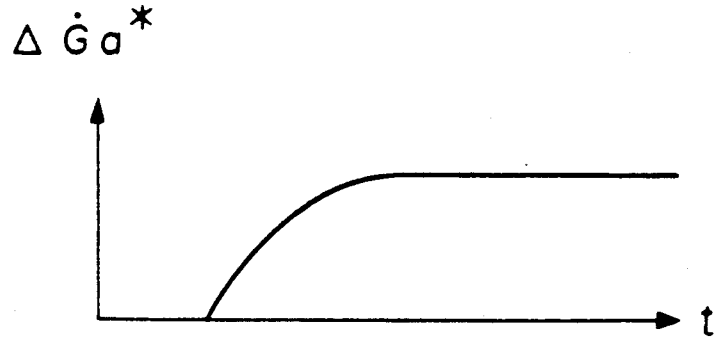
Figure 3:
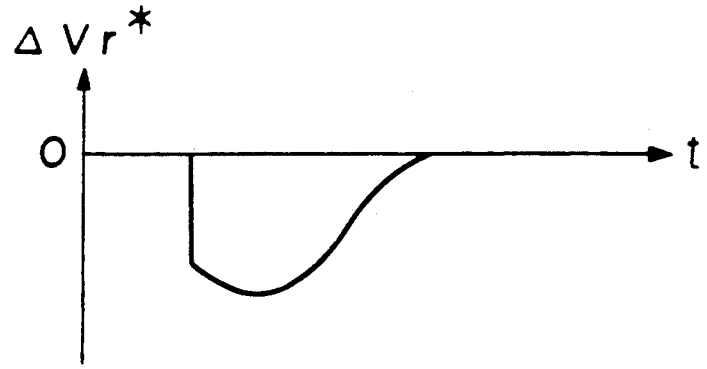

Namely, when the input $\Delta Va^*$ to the actuator 3 is given in proportion to the variation $\Delta Ia^*$ in the load current of the alternator, it is possible to always eliminate the variation in the engine speed despite of the variation $\Delta Ia^*$ in the load current of any alternator by controlling the set voltage to the regulator as given by the equation (6). FIG. 3 mentioned above is obtainable by plotting the time waveforms $\Delta Ia^*$, $\Delta Va^*$, $\Delta Ga^*$ and $\Delta Vr^*$ in the case of a stepped variation ($=1/S$). $\Delta Ia^*$ and $\Delta Va^*$, being stepped variations, are not explained here. Next, the time waveform of $\Delta Vr^*$ can be obtained as follows. By substituting $\Delta Ia^* = 1/S$ in the equation (6), $$\Delta Vr^* = -\frac{2S\{S\tau a\tau v - \tau v - \tau a\}}{(1 - S\tau a)(1 - S\tau v)}$$

Therefore the variation $\Delta Vr^*$ to be obtained in the set voltage to the regulator is given by Laplace inversion. By executing this, $$\Delta Vr^* = [\tau a \cdot e^{-t/\tau a} - \tau v \cdot e^{-t/\tau v}]/(\tau v - \tau a) \quad (7)$$

In FIG. 3*d*, $\Delta Vr^*$ denotes the time waveform of $\Delta Vr^*$ when $\tau v > \tau a$ (the same time waveform can be obtained by $\tau v < \tau a$). In the above example, the input $\Delta Ia^*$ varies in steps. More generally, however, it is possible to reduce the variation in the engine speed to zero in the event of any electrical load disturbance $\Delta Ia^*$by controlling s $Vr^*$ to $\Delta Vr^*$ which is given by $$\Delta Vr^* = -\frac{d}{dt} L^{-1}\left[\frac{S\tau a\tau v - \tau v - \tau a}{(1 - S\tau a)(1 - S\tau v)} \Delta Ia^*\right] \quad (8)$$

while controlling the input $\Delta Va^*$ to the actuator 3 to $\Delta Va^* = 2To/Kp \times \Delta Ia^*$. In this equation (8) the symbol $L^{-1}[\ ]$ expresses Laplace inversion of the function in [ ].

On the basis of the equation (8), $\Delta Vr^*$ (t) can formulated in relation to the common variation $\Delta Ia^*$ (t), from the theorem of composed integration as follows.

$$-\frac{d}{dt}\int_0^t \Delta vr^*(t)\, \Delta Ia^*(t - \lambda)d\lambda \quad (9)$$

where $\Delta vr^*$ (t) is a function given by the equation (7). It is understood that when $\Delta Ia^*$ is a stepped variation and fixed in the range of 0 to t, the differentiation and integration of the equation (9) are canceled and $\Delta Vr^*$ of the equation (9) agrees with the equation (7).

Figure 4:
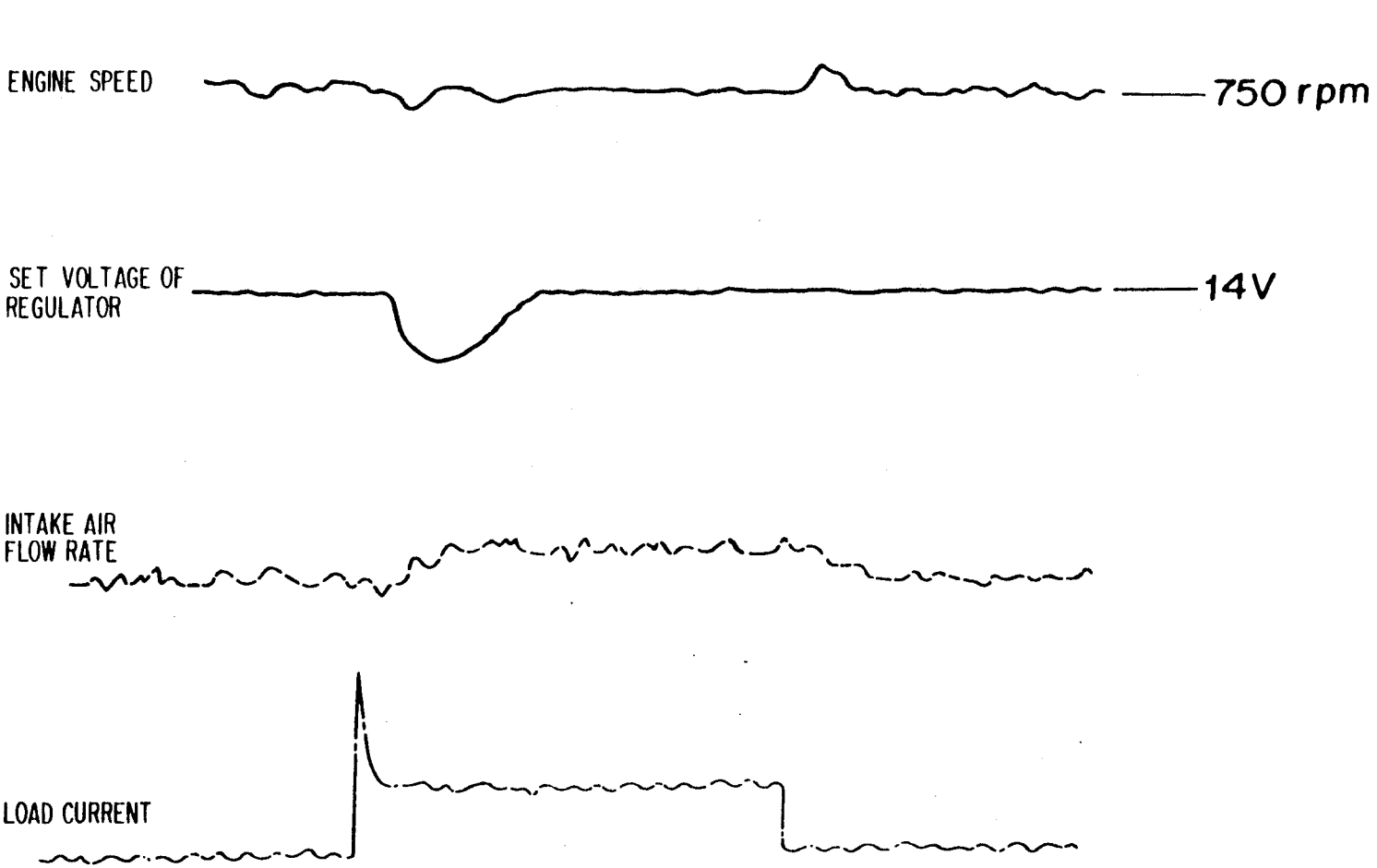
FIGS. 4*a* to 4*d* are characteristic views showing the engine speed, the set voltage of the regulator, the flow rate of intake air, and a measured value of the load current.
Figure 5:
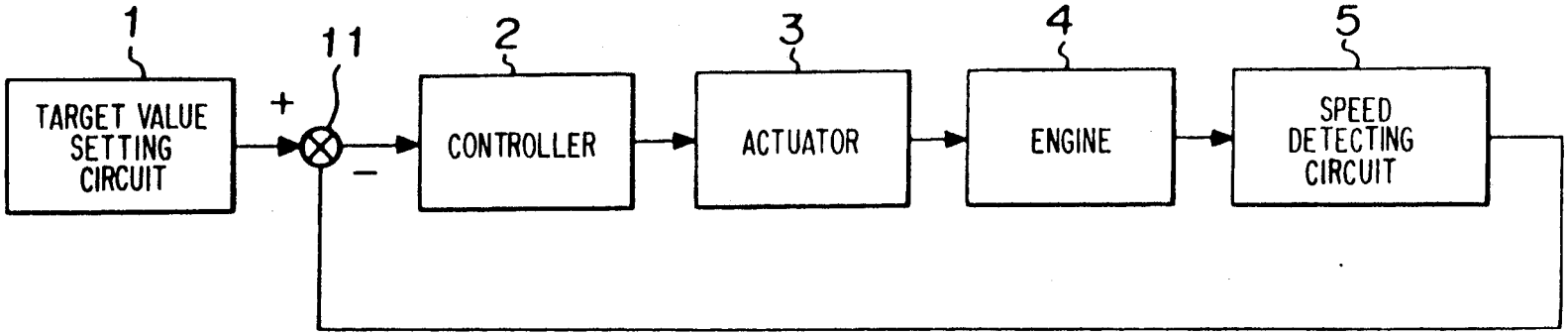
FIGURE 5 PRIOR ART
FIG. 5 is a block diagram showing a conventional engine speed control device.
Figure 6:
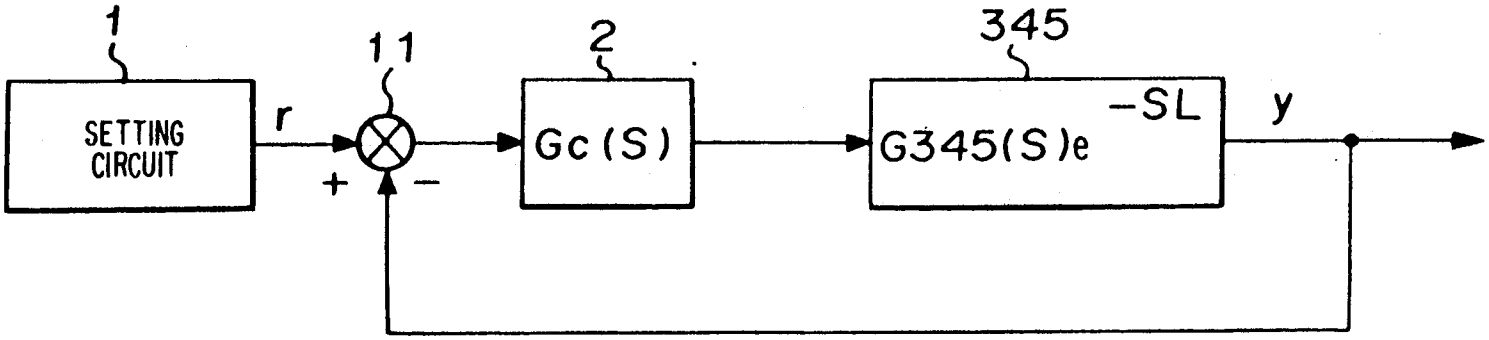
FIGURE 6 PRIOR ART
FIG. 6 is a block diagram expressing the block of FIG. 5 by means of a transmission function.
Figure 7:
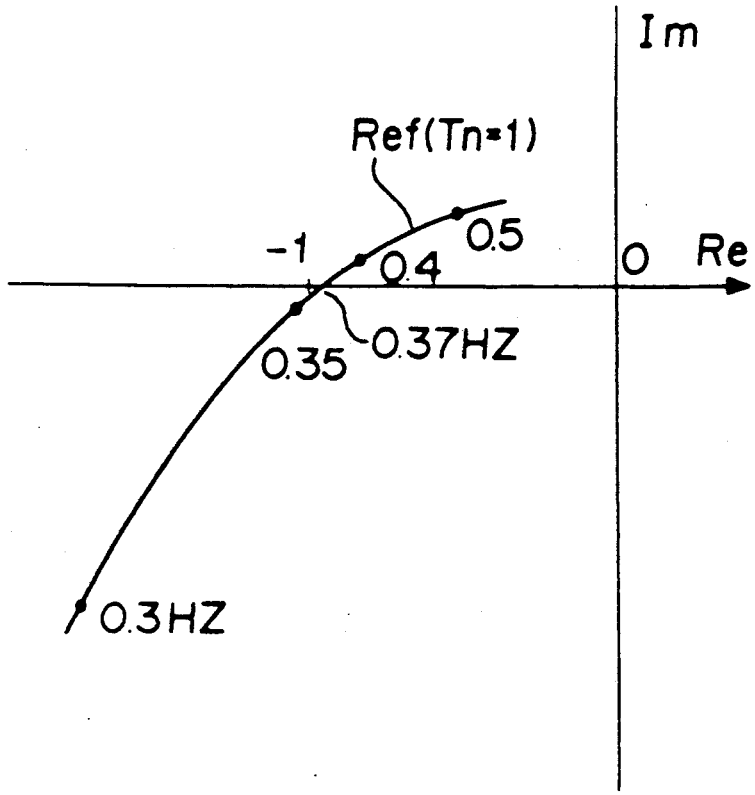
FIGURE 7 PRIOR ART
FIG. 7 is a Nyquist diagram of the block diagram in FIG. 6.

FIG. 4*a* shows a result of engine speed control after the execution of control of the air flow rate (FIG. 4*c*) and the regulator set voltage (FIG. 4*b*). The result thus obtained is so satisfactory that a variation in the rotational speed caused by the electrical load disturbance in FIG. 4*d* is hardly seen.

As is clear from the equation (8), $\Delta Vr^*$ includes parameters $\tau v$ and $\tau a$; it is therefore necessary to change the time pattern for the set voltage of the regulator in accordance with the characteristics of the actuator 3, the balanced speed of engine, volumetric efficiency, the volume of intake manifold, the displacement of engine, and the operating point of engine. The substance of the present invention resides in reducing a load applied to the engine by controlling the amount of current produced by the alternator only during the period when the intake air is delayed. Therefore, it is also necessary to control not only the set voltage for the control of the amount of current produced but the feedback gain Kf of the regulator. This is because reducing the feedback gain can decrease the torque demanded of the engine by the alternator during a transient period when the load is applied (the aforementioned formularization was effected when Kf was sufficiently large; in the formula, therefore, Kf was not given).

Furthermore, in the above example the load current of the alternator was detected, but the field current also may be detected because the field current can represent the load although slightly delayed as compared with the load current.

Furthermore, the embodiment described above dealt only with the rotational speed control in the case of an electrical load disturbance. In the case of a mechanical load disturbance, a similar effect of control can be obtained as in the case of the electrical load disturbance by detecting a mechanical load (torque) in place of the electric current.

Also, the example given above has described the control of the intake air and the amount of the current produced by the alternator, but it is also possible to obtain the same effect by adding ignition timing as the quantity of control. That is, when the increment of the intake air is delayed to produce the torque, the amount of the electric current to be produced by the alternator is reduced for the purpose of decreasing the torque demanded by the alternator and at the same time the ignition timing is advanced to increase the torque as quickly as possible.

Furthermore, the present invention is applicable to diesel engines, because the same effect of control is obtainable by controlling the quantity of fuel injected in place of the intake air flow rate.

According to the present invention, as described above, the rotational speed control device is so constituted as to detect a torque variation which is a disturbance, and to control the relation between the amount of the electric current produced by the alternator and the flow rate of intake air (or the quantity of fuel injected) in accordance with the torque variation, thereby reducing the amount of the electric current to be produced by the alternator only during a period when the increment in the amount of intake air (or fuel injection) is delayed, for the purpose of stabilizing the engine speed. It is, therefore, effective to always maintain a constant engine speed in the event of any load disturbance.

Furthermore, according to another embodiment of the present invention, the same effect is obtainable as the embodiment of the present invention described above because of its constitution that the torque variation which is a disturbance is detected; and the amount of the electric current produced by the alternator, the intake air flow rate (or the quantity of fuel injected) and the ignition timing are controlled in relation, thereby decreasing the amount of the electric current to be produced by the alternator and also advancing the ignition timing in order to stabilize the engine speed.

What is claimed is:

1. A rotational speed control device of an internal combustion engine whose speed idles at a predetermined steady level, said engine having an alternator and an actuator for controlling an intake air flow rate, said rotational speed control device comprising:

means for detecting a variation in engine torque;

means for controlling said actuator;

means for detecting delay characteristics of said actuator that effect said air flow rate to said engine; and means for controlling an amount of electric current generated by said alternator in accordance with said detected delay characteristics of said actuator;

wherein, by controlling said amount of current generated by said alternator, said engine torque is reduced so that said engine speed is maintained at said predetermined steady level.

2. The rotational speed control device as claimed in claim 1, wherein said engine further comprises a second actuator for controlling ignition timing, and said rotational speed control device further comprises means for controlling said second actuator such that by controlling said ignition timing in accordance with said detected delay characteristics of said actuator said engine torque is reduced so that said engine speed is maintained at said predetermined steady level.

3. A rotational speed control device of an internal combustion engine whose speed idles at a predetermined steady level, said engine having an alternator and an actuator for controlling a quantity of fuel injected, said rotational speed control device comprising:

means for detecting a variation in engine torque;

means for controlling said actuator;

means for detecting delay characteristics of said actuator that affect said quantity of fuel injected into said engine; and means for controlling an amount of electric current generated by said alternator in accordance with said detected delay characteristics of said actuator;

wherein, by controlling said amount of current generated by said alternator, said engine torque is reduced so that said engine speed is maintained at said predetermined steady level.

4. The rotational speed control device as claimed in claim 3, wherein said engine further comprises a second actuator for controlling ignition timing, and said rotational speed control device further comprises means for controlling said second actuator such that by controlling said ignition timing in accordance with said detected delay characteristics of said actuator said engine torque is reduced so that said engine speed is maintained at said predetermined steady level.

* * * * *